US011286140B2

(12) United States Patent
Andersen et al.

(10) Patent No.: US 11,286,140 B2
(45) Date of Patent: Mar. 29, 2022

(54) FLOOR JACK LOCKOUT ASSEMBLY

(71) Applicant: Snap-on Incorporated, Kenosha, WI (US)

(72) Inventors: Jonathan I. Andersen, Mount Pleasant, WI (US); James T. Rettler, Kenosha, WI (US); Benjamin T. Schulz, Racine, WI (US)

(73) Assignee: Snap-on Incorporated, Kenosha, WI (US)

( * ) Notice: Subject to any disclaimer, the term of this patent is extended or adjusted under 35 U.S.C. 154(b) by 235 days.

(21) Appl. No.: 16/434,730

(22) Filed: Jun. 7, 2019

(65) Prior Publication Data

US 2020/0385251 A1 Dec. 10, 2020

(51) Int. Cl.
*B66F 5/04* (2006.01)
*B66F 1/02* (2006.01)

(52) U.S. Cl.
CPC ..... *B66F 5/04* (2013.01); *B66F 1/025* (2013.01)

(58) Field of Classification Search
CPC .... B66F 5/04; B66F 5/00; B66F 1/025; B66F 3/24; B66F 3/16; B66F 3/08; E21D 15/44
See application file for complete search history.

(56) References Cited

U.S. PATENT DOCUMENTS

| | | | | |
|---|---|---|---|---|
| 2,182,676 A | | 12/1939 | Nilson | |
| 4,690,378 A | | 9/1987 | Jarman et al. | |
| 4,727,995 A | | 3/1988 | Louw | |
| 5,221,073 A | * | 6/1993 | Shockley | B66F 5/04 254/8 B |
| 5,261,641 A | | 11/1993 | Ployer | |
| 5,984,270 A | * | 11/1999 | Hussaini | B66F 5/04 254/2 B |
| 8,066,259 B2 | * | 11/2011 | Fang | B66F 5/04 254/8 B |
| 8,876,084 B1 | * | 11/2014 | Erwin | B66F 5/04 254/8 B |
| 2008/0067480 A1 | | 3/2008 | Hernandez, Jr. et al. | |
| 2008/0083913 A1 | | 4/2008 | Fang et al. | |
| 2011/0062401 A1 | | 3/2011 | Shen et al. | |
| 2018/0118538 A1 | | 5/2018 | Latvys | |

FOREIGN PATENT DOCUMENTS

| | | |
|---|---|---|
| CN | 101665222 A | 3/2010 |
| CN | 203877843 U | 10/2014 |
| CN | 106904553 A | 6/2017 |

(Continued)

OTHER PUBLICATIONS

UK Combined Search and Examination Report for Application No. GB2004507.6, 5 pages.

(Continued)

*Primary Examiner* — Seahee Hong
(74) *Attorney, Agent, or Firm* — Seyfarth Shaw LLP

(57) ABSTRACT

A floor jack locking assembly is presented. The locking assembly may include a locking pin used to mechanically lock out the jack at a specified lift height. The locking assembly may avoid the hydraulic lift cylinder being the only stabilizing component of the jack when supporting a significant load. The locking pin may be coupled to lifting link arms, avoiding the need to have the locking pin inserted into or through the lifting arm of the jack.

26 Claims, 6 Drawing Sheets

(56) References Cited

FOREIGN PATENT DOCUMENTS

| | | | |
|---|---|---|---|
| CN | 206814331 | U | 12/2017 |
| GB | 2309020 | A | 7/1997 |
| TW | M253595 | U | 12/2004 |
| TW | 201529029 | | 8/2015 |

OTHER PUBLICATIONS

Examination Report for corresponding Australian Application No. 2020202138 dated Mar. 5, 2021, 8 pages.
Taiwan Office Action for corresponding Taiwan Application No. 11020591200 dated Jun. 24, 2021, 7 pages.
Canadian Office Action for corresponding Canadian Application No. 3,082,213 dated Jun. 29, 2021, 3 pages.
Chinese Office Action for corresponding Chinese Application No. 202010506643.9 dated Jul. 27, 2021, 7 pages.

* cited by examiner

FLOOR JACK LOCKOUT ASSEMBLY

TECHNICAL FIELD OF THE INVENTION

The present application relates generally to jacks. More particularly, the present invention relates to a lockout assembly adapted to lock a jack securely at multiple operational heights.

BACKGROUND OF THE INVENTION

Floor jacks are used in repair shops to lift a vehicle from the ground. An operator positions the floor jack underneath a lift point and raises the vehicle at that point. Floor jacks can be powered by manual or automated means, and have become important to the automotive repair industry.

Shop floor jacks are required to withstand large weights, such as that of a vehicle. The majority of floor jacks are hydraulic or air-over-hydraulic actuated devices. It is a recommended practice that after a vehicle is raised into position using a jack, one or more jack stands are placed under the vehicle and the vehicle is lowered onto the stand(s). Stands are typically telescoping tube designs held at height with a cross pin. The use of stands replaces the use of fluids holding the load in place with mechanical steel pins. This approach, however, relies on the jacks to raise vehicles at the same point the jack stand needs to be placed.

SUMMARY OF THE INVENTION

The present invention relates broadly to a floor jack locking assembly with a locking pin used to mechanically lock out the jack at a specified lift height. The locking assembly may include a locking pin used to mechanically lock out the jack at a specified lift height. The locking assembly may avoid the hydraulic lift cylinder being the only stabilizing component of the jack when supporting a significant load. The locking pin may be coupled to lifting link arms, avoiding the need to have the locking pin inserted into or through the lifting arm of the jack.

The locking assembly may avoid the hydraulic lift cylinder being the only stabilizing component of the jack when supporting a significant load.

In an embodiment, the present invention relates broadly to a floor jack. The floor jack includes a frame including lock pin holes, a lifting arm pivotally coupled to the frame, a lifting mechanism coupled to the lifting arm, and a locking assembly. The locking assembly may include a lifting link arm coupled to the lifting mechanism, a locking pin adapted to couple the lifting link arm and the frame through at least one of the lock pin holes, and a handle pivotally coupled to the lifting mechanism.

In another embodiment, the present invention relates broadly to a floor jack. The floor jack includes a frame including lock pin holes, a lifting arm pivotally coupled to the frame, a lifting mechanism coupled to the lifting arm, a lifting link arm coupled to the lifting mechanism, wherein the lifting arm includes a pin lifting arm hole. A lock pin is adapted to engage the frame and the lifting link arm through at least one of the lock pin holes to mechanically lock the lifting mechanism, and a handle is pivotally coupled to the lifting mechanism.

BRIEF DESCRIPTION OF THE DRAWINGS

For the purpose of facilitating an understanding of the subject matter sought to be protected, there is illustrated in the accompanying drawing embodiments thereof, from an inspection of which, when considered in connection with the following description, the subject matter sought to be protected, its construction and operation, and many of its advantages, should be readily understood and appreciated.

DETAILED DESCRIPTION

Figure 1:
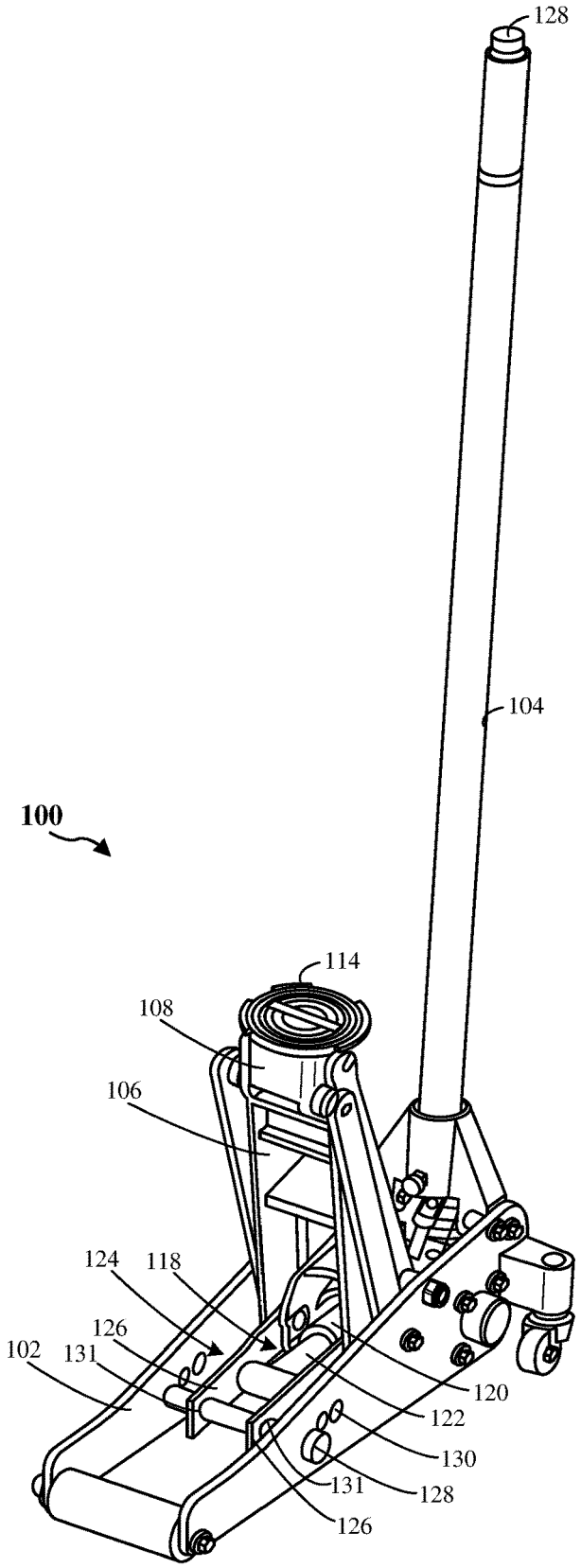
FIG. 1 is a perspective view of a jack incorporating a locking assembly according to an aspect of the present disclosure.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly relates to a floor jack and a multi-height locking assembly. The multi-height locking assembly provides additional security to prevent the hydraulic from being the only locking mechanism on the jack. According to one aspect, the locking assembly disclosed herein may allow the jack to be locked mechanically to further protect against a failure in the hydraulic system of the jack while under a load. Additionally, in circumstances in which a significant load, such as a vehicle, would normally be transferred to a jack stand after lifting, the locking assembly disclosed herein may allow a mechanical lockout of the hydraulics and eliminate the need for the jack stand at the lift point of the load.

Figure 2:
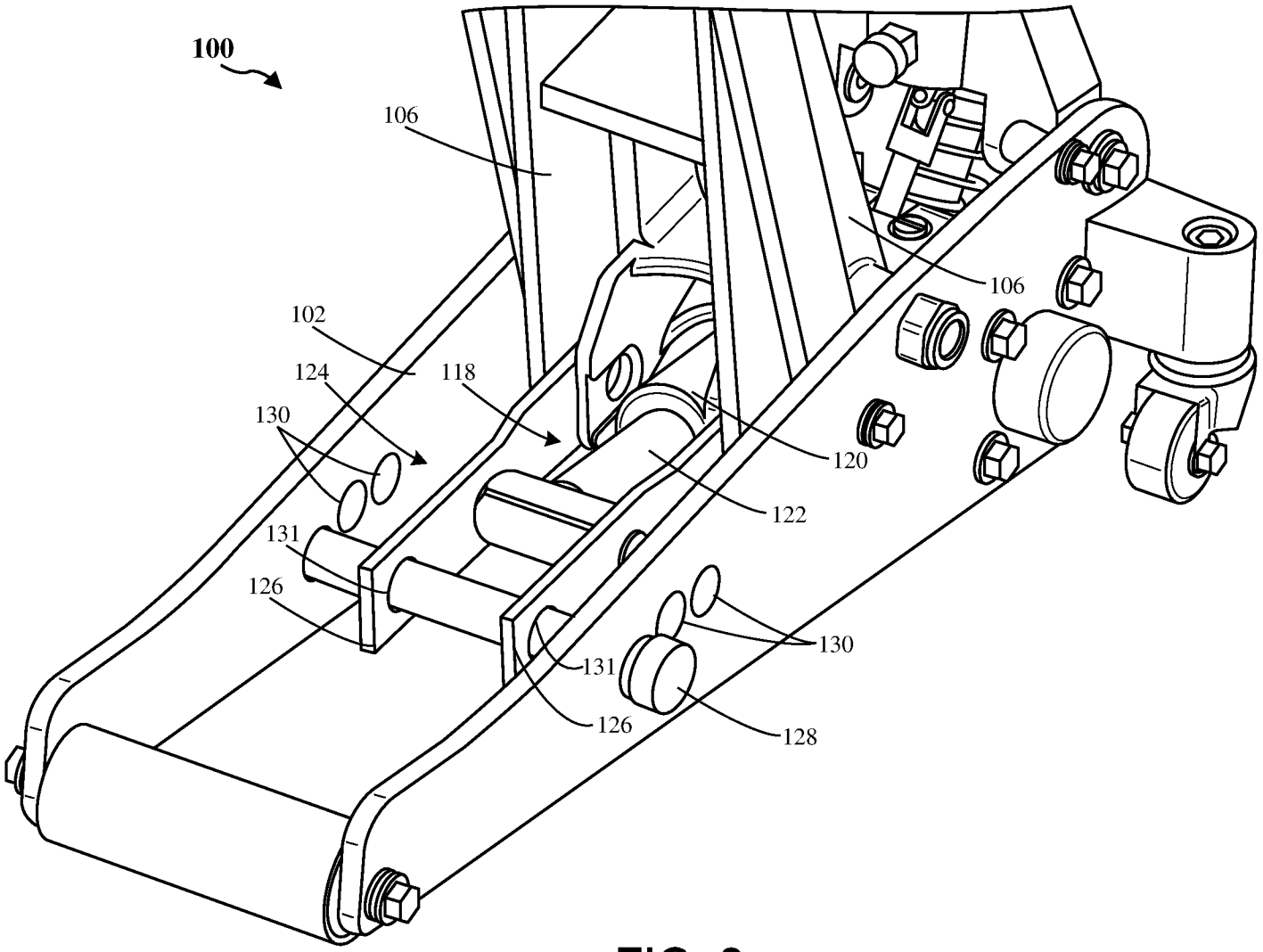
FIG. 2 is an expanded perspective view of the jack of FIG. 1 according to an aspect of the present disclosure.

While the jack and locking assembly described herein may be described in connection with lifting a vehicle as the load, one skilled in the art will recognize that aspects of the present disclosure may be implemented to support any load. Referring to FIGS. 1 and 2, a jack 100 includes a handle 104 operably coupled to a lifting arm 106 that is coupled to and movable relative to the frame 102 in response to motion of the handle 104. A saddle base 108 is coupled to the lifting arm 106 and moves with the lifting arm 106 in response to motion of the handle 104, allowing the saddle base 108 to raise the vehicle. The saddle base 108 may support a saddle 114 on a vehicle-facing surface of the saddle base 108 to help avoid marring or damaging the vehicle. The saddle base 108 and/or saddle 114 may be changeable to accommodate different types of lift points, depending upon the vehicle.

The hydraulics of the jack 100 are part of a power unit 118. The power unit 118 may include a lift piston 122 that is slidable within a lift-piston assembly 120 of the power unit 118, and that may be coupled to a locking assembly 124.

Locking assembly 124 may include lifting link arms 126. A locking pin 128 may be inserted into one of a number of lock pin holes 130 and pin lifting arm holes 131 in the link arms 126. The lock pin holes 130 are disposed on opposing sides of the frame 102. For example, the frame 102 may include first and second side portions. The first side portion includes first lock pin holes 130, and the second side portion includes second lock pin holes 130 that align with the first lock pin holes 130, respectively.

When the locking pin 128 is inserted into one of the first lock pin holes 130, extended through the pin lifting arm holes 131 in the lifting link arm 126 and across the frame 102, and inserted into the corresponding second lock pin hole 130, the hydraulics from the power unit 118 become mechanically locked in place. The lock pin 128 maintains the lateral position of the lift piston assembly 120 and therefore will lock the lifting arm 106 in place. The locking pin 128 prevents the lateral movement of the lifting link arms 126 regardless of the hydraulics in the power unit 118. That is, the lifting arm 106 is not dependent on the hydraulics for maintaining the jack height. The lock pin 128 provides a mechanical locking solution that is stable and capable of withstanding significant weight from the load. As mentioned above, this may eliminate the need for additional support structures, such as jack stands, and the substitution of those supports under a vehicle for the jack.

Figure 3:
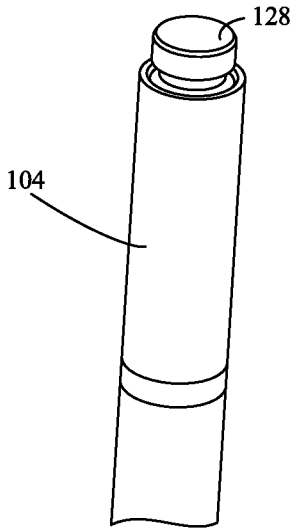
FIG. 3 is a perspective view of a jack handle with stored locking pin according to an aspect of the present disclosure.
Figure 4:
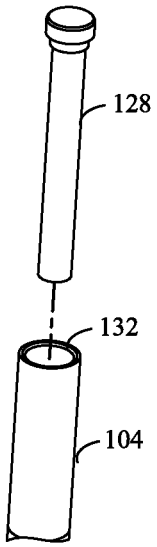
FIG. 4 is an exploded view of jack handle of FIG. 3.

Referring to FIGS. 3-4, the handle 104 of the jack 100 may include a storage location for the locking pin 128. According to one aspect of the disclosure the handle 104 may include a recess 132 or cavity in a proximal end to receive the locking pin 128. The locking pin may be sized and shaped to be just smaller than the recess 132 to form a friction fit securing the locking pin 128 in the recess 132 of the handle 104. Alternative securing mechanisms may be implemented, including gaskets, O-rings, flanges, spring, push-button, or the like, that allow the locking pin 128 to be securely stored in the handle 104, yet easily removable by a user.

Figure 5:
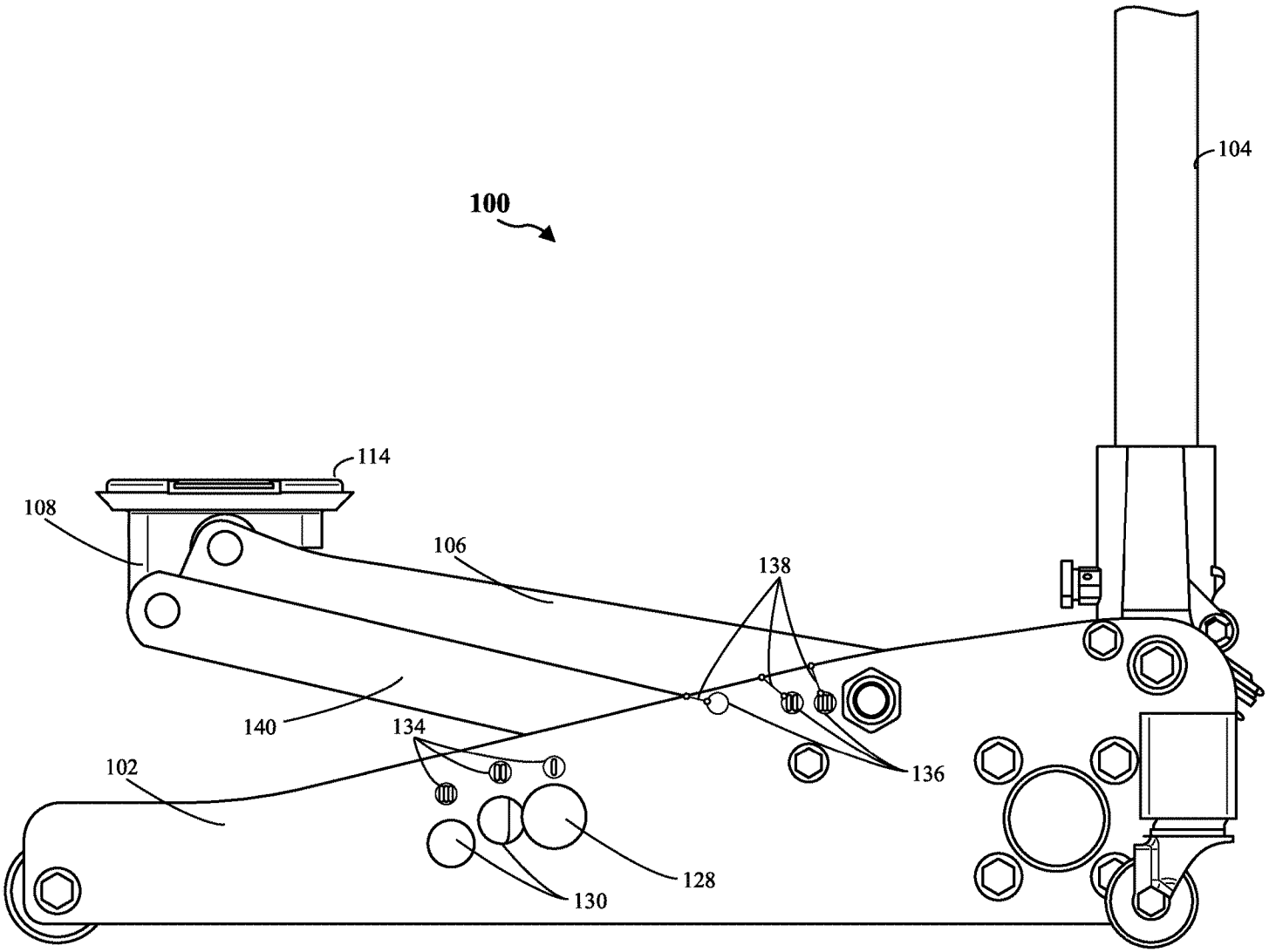
FIG. 5 is a side view of the jack of FIG. 1 in a first locking position according to an aspect of the present disclosure.
Figure 6:
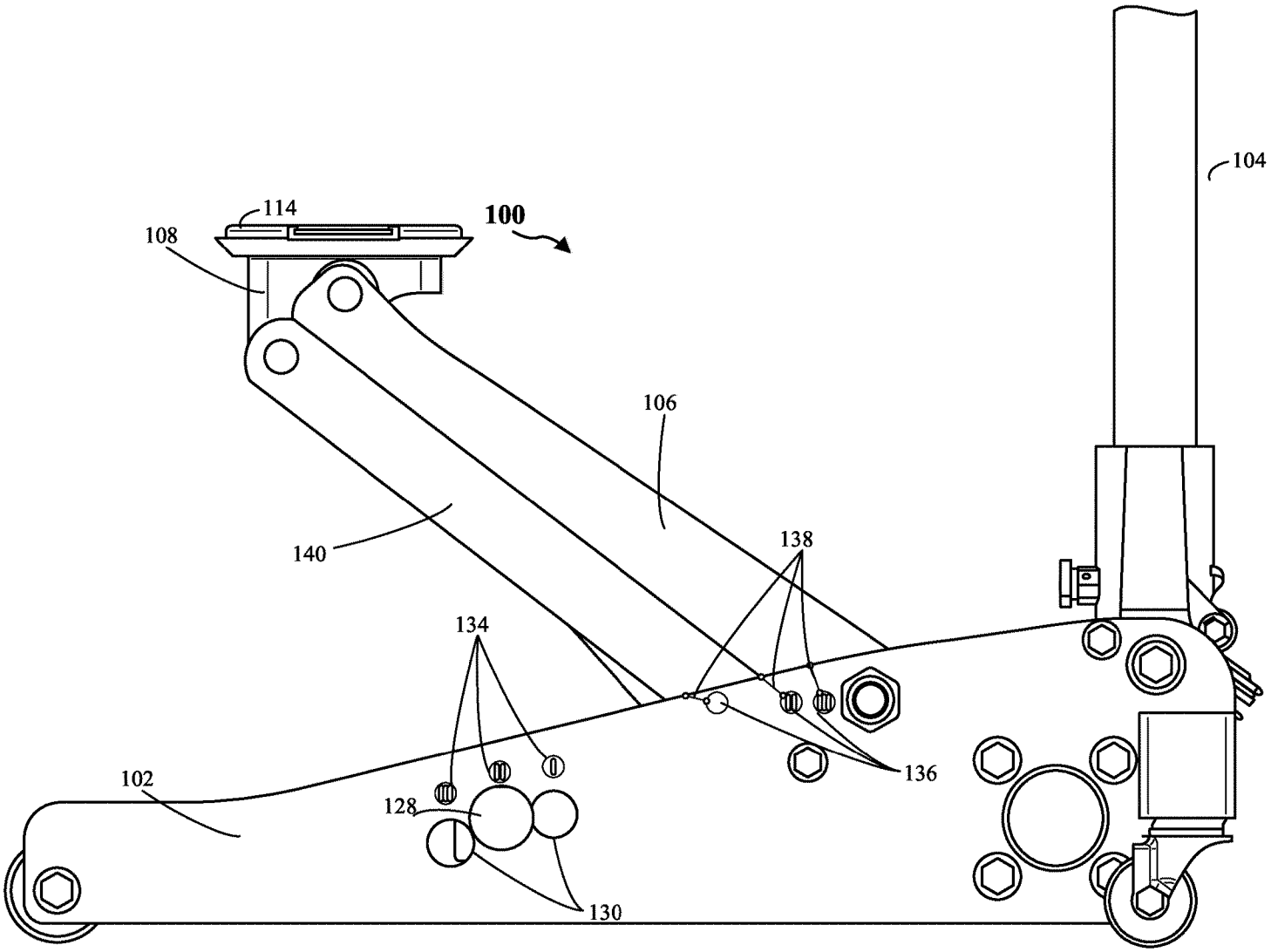
FIG. 6 is a side view of the jack of FIG. 1 in a second locking position according to an aspect of the present disclosure.
Figure 7:
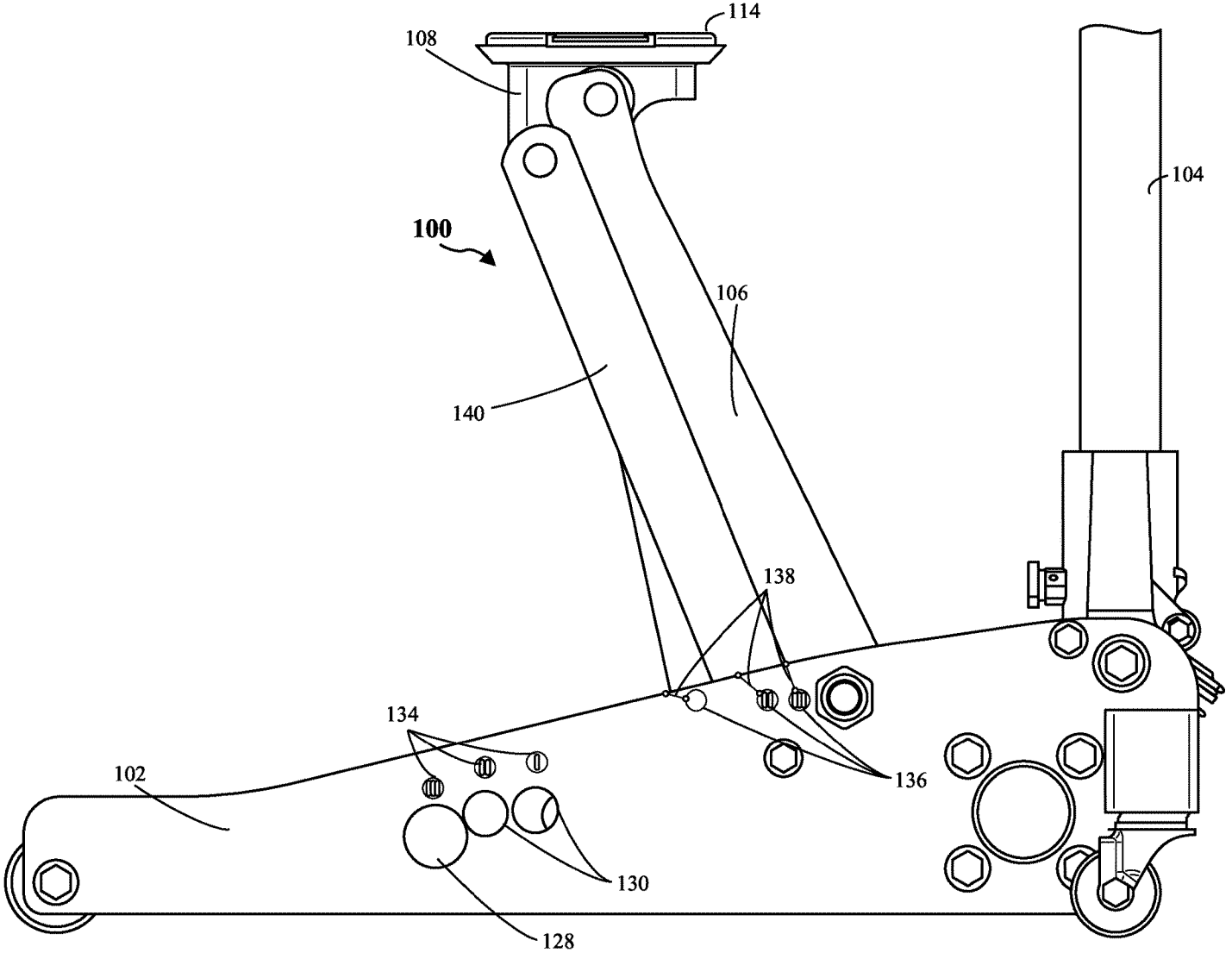
FIG. 7 is a side view of the jack of FIG. 1 in a third locking position according to an aspect of the present disclosure.

FIGS. 5-7 depict side-views of the jack 100 in various positions of lift height. According to one aspect, the jack may have multiple sets of first and second lock pin holes 130 to receive the locking pin 128, each set of first and second locking holes representing a different height of the lifting arm 106. The lock pin holes may include labels 134 on the jack frame 102 indicating a numbered position or other indicator of locked position. Exemplary labels may include, without limitation, I, II, III; low, middle, high; min, mid, max; or the like. FIG. 5 depicts the jack 100 in a first height position, depicted as position I at the lowest locking height. The jack frame 102 may also include corresponding secondary position labels 136 that align with a line or surface of a support bar 140 coupled to the saddle base 108. Alignment lines 138 may extend from the secondary position labels 136. The alignment lines 138 may be sized and shaped to align with the support bar 140. The labeling scheme shown in FIGS. 5-7 provide a visual indicator to the user of the position of the jack that will allow the jack to engage the mechanical locking assembly. As the user actuates the jack 100, causing the lifting arm 106 to rise and lower the load, the user may visually monitor the alignment of the support bar 140 with the alignment lines 138 and secondary position indicators 136. When the support bar aligns with the alignment line 138 of the desired position, the user may insert the locking pin 128 in to the corresponding first and second lock pin holes 130 with the corresponding label 134.

FIG. 6 depicts the jack 100 in a second height position, labeled position II. The support bar 140 now aligns with the alignment line 138 corresponding to the secondary position label 136, labeled position II. FIG. 7 depicts the jack 100 in a third height position, labeled position III. The support bar 140 now aligns with the alignment line 138 corresponding to the secondary position label 136, labeled position III. When the user desires to lower the jack, the locking pin 128 may be removed and stored in the handle 104, and the jack may be lowered.

The locking assembly of the present disclosure is advantageous over traditional jacks in that the locking assembly provides a secure mechanism to lock the jack mechanically without relying on, or stressing the hydraulics. The locking assembly also provides for multiple locking positions and a user-friendly manner of indicating to a user when the jack is in a locking position.

From the foregoing, it can be seen that there has been described improved jack with a trunnion block assembly that includes one or more trunnions coupled to a block such that upon actuation of a power unit, including a piston, the trunnion block assembly displaces connection plates coupled to a lifting arm of the jack. The multi-component trunnion block assembly provides a structural advantage over a unitary body trunnion block with the trunnions formed as part of the body.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object. As used herein, the term "a" or "one" may include one or more items unless specifically stated otherwise.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A floor jack, comprising:

a frame including lock pin holes;

a lifting arm pivotally coupled to the frame;

a lifting mechanism coupled to the lifting arm;

a lifting link arm coupled to the lifting mechanism; and a locking pin adapted to couple the lifting link arm and the frame through at least one of the lock pin holes; and a handle pivotally coupled to the lifting mechanism, wherein the handle includes a recess adapted to receive the locking pin.

2. The floor jack of claim 1, wherein the lifting link arm includes a pin lifting arm hole adapted to receive the locking pin.

3. The floor jack of claim 1, further comprising first position indicators disposed on the frame.

4. The floor jack of claim 3, further comprising alignment indicators that respectively correspond to the first position indicators.

5. The floor jack of claim 4, further comprising secondary position indicators disposed on the frame proximal to the lock pin holes, wherein the secondary position indicators respectively correspond to the first position indicators.

6. The floor jack of claim 1, wherein the lock pin holes includes first, second, and third lock pin holes, the first lock pin hole corresponding to a first locked position, the second lock pin hole corresponding to a second locked position, and the third lock pin hole corresponding to a third locked position.

7. The floor jack of claim 6, further comprising a first set of position indicators disposed on the frame;

a first set of alignment indicators disposed on the frame proximal to the first set of position indicators;

a secondary set of position indicators disposed on the frame proximal to the lock pin holes;

wherein the locking pin is adapted to be disposed in the first lock pin hole when a support bar of the floor jack is aligned with a first alignment indicator of the first set of alignment indicators that is proximal to a first position indicator of the first set of position indicators.

8. The floor jack of claim 1, wherein the lock pin holes include a first set of lock pin holes and a second set of lock pin holes, the first set of lock pin holes disposed on an opposite side of the frame from the second set of lock pin holes.

9. The floor jack of claim 8, wherein the locking pin is adapted to be disposed in the first and second sets of lock pin holes.

10. A floor jack comprising:

a frame including first and second side portions that respectively form exterior sides of the floor jack, and lock pin holes extending through the first side portion;

a lifting arm pivotally coupled to the frame;

a lifting mechanism coupled to the lifting arm:

a lifting link arm coupled to the lifting mechanism, wherein the lifting link arm includes a pin lifting arm hole;

a lock pin adapted to engage the frame and the lifting link arm by being disposed through at least one of the lock pin holes and into the pin lifting arm hole to mechanically lock the lifting mechanism; and a handle pivotally coupled to the lifting mechanism.

11. The floor jack of claim 10, further comprising first position indicators disposed on the frame.

12. The floor jack of claim 11, further comprising alignment indicators that respectively correspond to the first position indicators.

13. The floor jack of claim 12, further comprising secondary position indicators disposed on the frame proximal to the lock pin holes, wherein the secondary position indicators respectively correspond to the first position indicators.

14. The floor jack of claim 10, wherein the lock pin holes includes first, second, and third lock pin holes, the first lock pin hole corresponding to a first locked position, the second pin hole corresponding to a second locked position, and the third lock pin hole corresponding to a third locked position.

15. The floor jack of claim 14, further comprising a first set of position indicators disposed on the frame;

a first set of alignment indicators disposed on the frame proximal to the first set of position indicators;

a secondary set of position indicators disposed on the frame proximal to the lock pin holes;

wherein the lock pin is adapted to be disposed in the first lock pin hole when a support bar of the floor jack is aligned with a first alignment indicator of the first set of alignment indicators that is proximal to a first position indicator of the first set of position indicators.

16. The floor jack of claim 10, wherein the lock pin holes includes a first set of lock pin holes, and the frame includes a second set of lock pin holes on the second side portion opposite from the first set of lock pin holes.

17. The floor jack of claim 16, wherein the lock pin is adapted to couple the lifting link arm and the frame through the first and second sets of lock pin holes.

18. The floor jack of claim 10, wherein the lifting mechanism includes a hydraulic piston.

19. The floor jack of claim 10, wherein the handle includes a recess adapted to receive the lock pin.

20. A floor jack, comprising:

a frame including lock pin holes;

position indicators disposed on the frame;

alignment indicators disposed on the frame, wherein the alignment indicators respectively correspond to the position indicators;

a lifting arm pivotally coupled to the frame;

a lifting mechanism coupled to the lifting arm;

a lifting link arm coupled to the lifting mechanism; and a locking pin adapted to couple the lifting link arm and the frame through at least one of the lock pin holes; and a handle pivotally coupled to the lifting mechanism.

21. The floor jack of claim 20, wherein the lifting link arm includes a pin lifting arm hole adapted to receive the locking pin.

22. The floor jack of claim 20, further comprising secondary position indicators disposed on the frame proximal to the lock pin holes, wherein the secondary position indicators respectively correspond to the position indicators.

23. The floor jack of claim 20, wherein the lock pin holes includes first, second, and third lock pin holes, the first lock pin hole corresponding to a first locked position, the second lock pin hole corresponding to a second locked position, and the third lock pin hole corresponding to a third locked position.

24. The floor jack of claim 23, wherein the locking pin is adapted to be disposed in the first lock pin hole when a support bar of the floor jack is aligned with a first alignment indicator of the alignment indicators corresponding to a first position indicator of the position indicators.

25. The floor jack of claim 20, wherein the lock pin holes include a first set of lock pin holes and a second set of lock pin holes, the first set of lock pin holes disposed on an opposite side of the frame from the second set of lock pin holes.

26. The floor jack of claim 25, wherein the locking pin is adapted to be disposed in the first and second sets of lock pin holes.

* * * * *